US011160308B2

(12) United States Patent
Duffy et al.

(10) Patent No.: US 11,160,308 B2
(45) Date of Patent: Nov. 2, 2021

(54) LIGHTER

(71) Applicant: EPD Consulting Corporation, San Leandro, CA (US)

(72) Inventors: Emmet Duffy, Stevenson Ranch, CA (US); Eric Fan, Danville, CA (US); Xiao Yang, Dublin, CA (US)

(73) Assignee: EPD Consulting Corporation, San Leandro, CA (US)

( * ) Notice: Subject to any disclaimer, the term of this patent is extended or adjusted under 35 U.S.C. 154(b) by 0 days.

(21) Appl. No.: 16/197,610

(22) Filed: Nov. 21, 2018

(65) Prior Publication Data

US 2019/0154257 A1 May 23, 2019

Related U.S. Application Data

(60) Provisional application No. 62/589,790, filed on Nov. 22, 2017.

(51) Int. Cl.

| | |
|---|---|
| ***A24F 15/10*** | (2006.01) |
| ***A24F 15/18*** | (2006.01) |
| ***F23Q 2/32*** | (2006.01) |
| ***F23Q 2/36*** | (2006.01) |
| ***F23Q 2/50*** | (2006.01) |
| ***A24C 5/44*** | (2006.01) |
| ***B65D 1/36*** | (2006.01) |
| ***B65D 43/02*** | (2006.01) |
| ***A24D 1/02*** | (2006.01) |

(52) U.S. Cl.

CPC ..... *A24F 15/18* (2013.01); *A24C 5/44* (2013.01); *A24D 1/022* (2013.01); *A24F 15/10* (2013.01); *B65D 1/36* (2013.01); *B65D 43/02* (2013.01); *F23Q 2/32* (2013.01); *F23Q 2/36* (2013.01); *F23Q 2/50* (2013.01)

(58) Field of Classification Search

CPC ..... A24C 5/44; F23Q 2/02; F23Q 2/50

USPC ..... 431/344, 253, 350, 143, 146, 274, 255, 431/124, 273

See application file for complete search history.

(56) References Cited

U.S. PATENT DOCUMENTS

| | | | | | |
|---|---|---|---|---|---|
| 2,308,225 | A * | 1/1943 | Edenburg | B43K 29/16 | 431/139 |
| 3,069,886 | A * | 12/1962 | Coats | A24F 15/18 | 431/202 |
| 4,240,783 | A * | 12/1980 | Nevin | A24F 15/18 | 431/253 |
| 4,451,229 | A * | 5/1984 | Nitta | F23Q 2/32 | 401/195 |
| 4,819,666 | A * | 4/1989 | Turver | A24F 13/14 | 131/175 |
| 5,454,657 | A * | 10/1995 | Kim | B43K 24/026 | 401/195 |
| 2004/0219468 | A1* | 11/2004 | Hanosek | A24F 13/18 | 431/253 |
| 2006/0275726 | A1* | 12/2006 | Koropsak | A24F 15/10 | 431/253 |

(Continued)

*Primary Examiner* — Avinash A Savani

(74) *Attorney, Agent, or Firm* — Sughrue Mion, PLLC

(57) ABSTRACT

A lighter includes a lighter component that is configured to ignite a smokeable item. The lighter includes a housing that is connected to the lighter component and that includes a cavity. The lighter includes a component that permits access to the cavity of the housing to permit the smokeable item to be stored within the cavity of the housing.

1 Claim, 6 Drawing Sheets

(56) References Cited

U.S. PATENT DOCUMENTS

2009/0314662 A1* 12/2009 Kerlind ..... A24F 19/0085
206/86
2014/0026904 A1* 1/2014 Monty ..... A24F 13/18
131/256
2014/0030664 A1* 1/2014 Maimon ..... F23Q 2/32
431/253

* cited by examiner

LIGHTER

CROSS-REFERENCE TO RELATED APPLICATION

This application claims priority under 35 U.S.C. § 119 to U.S. Provisional Application No. 62/589,790, filed on Nov. 22, 2017, the contents of which are incorporated by reference in their entirety.

BACKGROUND

After assembling a smokeable item (e.g., a cigarette, a cigar, etc.), a user might desire to store the smokeable item for later usage. The user might place the smokeable item in a protective container to permit transport and/or storage of the smokeable item, and to prevent damage and/or destruction of the smokeable item. In this way, the user can carry the protective container in a pocket of an article of clothing, in a bag, in a purse, and/or the like.

Additionally, the user can carry a lighter to permit the user to ignite the smokeable item. Separately carrying a smokeable item and a lighter may result in misplacement of the smokeable item and/or the lighter, damage to the smokeable item (e.g., such as in cases where a protective container is not utilized), theft of the smokeable item and/or the lighter, and/or the like. As such, the user may become frustrated or annoyed, and/or may be required to procure additional smokeable ingredients and/or rolling paper. Further, separately carrying the smokeable item, the protective container, and/or the lighter imposes a burden on the user to carry each respective item.

SUMMARY

According to an aspect of the disclosure, a lighter includes a lighter component that is configured to ignite a smokeable item; a housing that is connected to the lighter component and that includes a cavity; and a component that permits access to the cavity of the housing to permit the smokeable item to be stored within the cavity of the housing.

DETAILED DESCRIPTION OF THE PREFERRED EMBODIMENT

Some implementations described herein provide a lighter that is configured to store a smokeable item and/or ignite the smokeable item. In this way, some implementations described herein reduce a need of the user to utilize a separate protective container for the smokeable item, reduce a number of separate items that a user is required to carry, reduce bulkiness, prevent damage and/or destruction of the smokeable item, improve concealment of the smokeable item, and/or the like.

Figure 1:
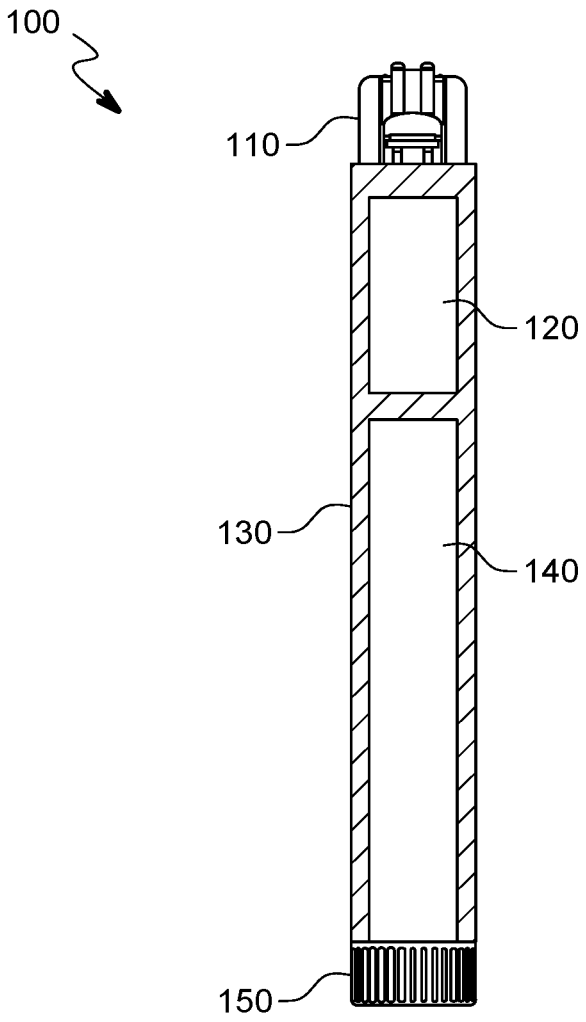
FIG. 1 is a diagram of a cross-section of a front view of an example lighter as described herein.

FIGS. 1-7 are diagrams of an example lighter 100 described herein. FIG. 1 is a cross-section of a front view of a lighter 100. As shown in FIG. 1, a lighter 100 may include a lighter component 110, a reservoir component 120, a housing component 130, a cavity component 140, and an accessibility component 150.

The lighter component 110 may include a component that is configured to ignite objects. For example, the lighter component 110 may include a naphtha lighter, a piezoelectric lighter, an electronic lighter, an arc lighter, a flameless lighter, and/or the like. It should be understood that implementations herein are applicable to any type of lighter component 110.

The reservoir component 120 may include a component that is configured to store fuel to be ignited by the lighter component 110. For example, the reservoir component 120 may include a container, a tank, a receptacle, a canister, a pouch, and/or the like. The fuel may include butane, naphtha, and/or the like. It should be understood that implementations herein are applicable to any type of fuel that may be ignited by the lighter component 110.

The housing component 130 may include a component that is configured to mechanically support the reservoir component 120 and/or the cavity component 140. Additionally, the housing component 130 may be configured to mechanically support the lighter component 110 and/or the accessibility component 150.

The housing component 130 may be comprised of any type of suitable material. For example, the housing component 130 may be comprised of polyethylene, polypropylene, aluminum, titanium, graphite, and/or the like. The housing component 130 may include any suitable shape. For example, the housing component 130 may be cylindrical, rectangular, square, and/or the like.

The cavity component 140 may include a component that is configured to store a smokeable item. Additionally, or alternatively, the cavity component 140 may store any other type of item that is capable of being disposed within the cavity component 140. For example, the cavity component 140 may include a cavity, of the housing component 130, that permits items to be placed and/or stored in the housing component 130.

The accessibility component 150 may include a component that is configured to provide access to the cavity component 140. For example, the accessibility component 150 may include a cap, a lid, a cover, a top, a covering, a sliding cover, and/or the like. The accessibility component 150 may be removable, partially removable, displaceable, and/or the like, to permit access to the cavity component 140. As an example, the accessibility component 150 may threadably engage with the housing component 130 to permit access to the cavity component 140.

The accessibility component 150 may be configured to connect to the housing component 130 via a connection mechanism. For example, the connection mechanism may include a set of threads, a hinge, a sliding mechanism, and/or the like. Alternatively, the accessibility component 150 may be configured to connect to housing component 130 via an interference fit, a press fit, a friction fit, and/or the like.

In some implementations, a user may use the lighter 100 as follows. To insert a smokeable item into the lighter 100, the user may manipulate the accessibility component 150 to permit access to the cavity component 140. For example, the user may unscrew the accessibility component 150 from the housing component 130. After, the user may insert a smokeable item into the cavity component 140 such that the smokeable item is disposed within the cavity component 140.

To store the smokeable item within the lighter 100, the user may manipulate the accessibility component 150 to secure the smokeable item within the cavity component 140. For example, the user may screw the accessibility component 150 onto the housing component 130. At this point, the smokeable item is secured with the cavity component 140 of the housing component 130. In this way, the user may carry the lighter 100 which includes the stored smokeable item.

To access the stored smokeable item, the user may manipulate the accessibility component 150 to permit access to the stored smokeable item. For example, the user may unscrew the accessibility component 150 and access the stored smokeable item.

To ignite the smokeable item, the user may interact with the lighter component 110 to ignite the smokeable item, and inhale smoke and/or vapor generated by the ignited smokeable item.

Figure 2:
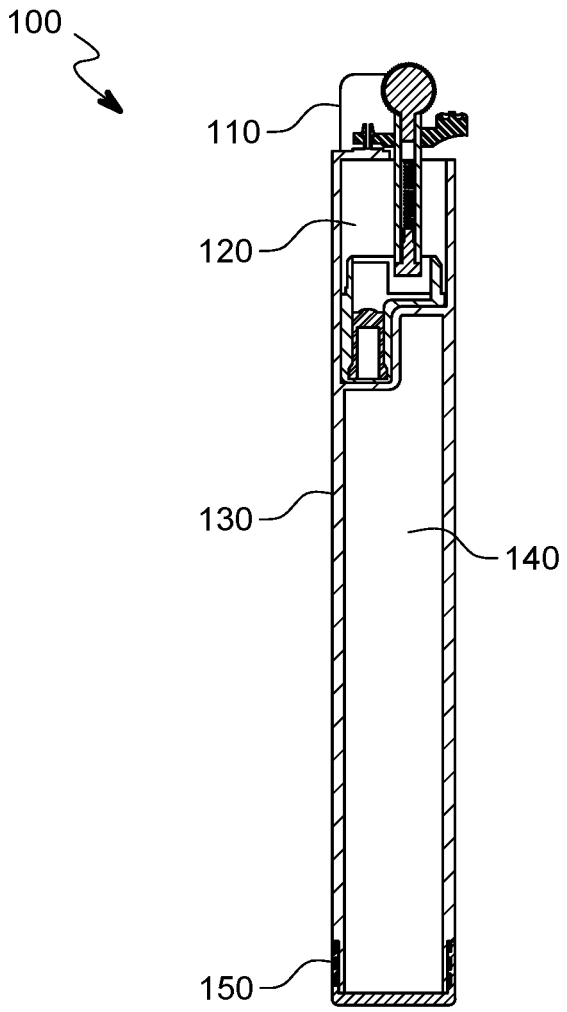
FIG. 2 is a diagram of a cross-section of a side view of an example lighter as described herein.

FIG. 2 is a diagram of a cross-section of a side view of the lighter 100. As shown in FIG. 2, the lighter component 110 and/or the reservoir component 120 may include various components. For example, the components may include a guard, a spark wheel, a hood, a fork, a flint, a fork spring, a jet, a valve, a flint spring, and/or the like. It should be understood that the lighter component 110 may include different components, fewer components, additional components, differently named components, and/or the like, than as compared to the components shown and/or described in connection with FIG. 2.

In some implementations, the reservoir component 120 may be adjacent to the lighter component 110. Additionally, or alternatively, cavity component 140 may be adjacent to the reservoir component 120. The cavity component 140 may extend towards a bottom end of lighter 100 in a vertical direction of the lighter 100. Additionally, the accessibility component 150 may be disposed at the bottom end of the lighter 100 to permit access to the cavity component 140.

The housing component 130 may include any suitable configuration that permits the reservoir component 120 and the cavity component 140 to be disposed within the housing component 130. The reservoir component 120 and the cavity component 140 may include any spatial relationship that permits both the reservoir component 120 and the cavity component 140 to concurrently be disposed within the housing component 130.

Figure 3:
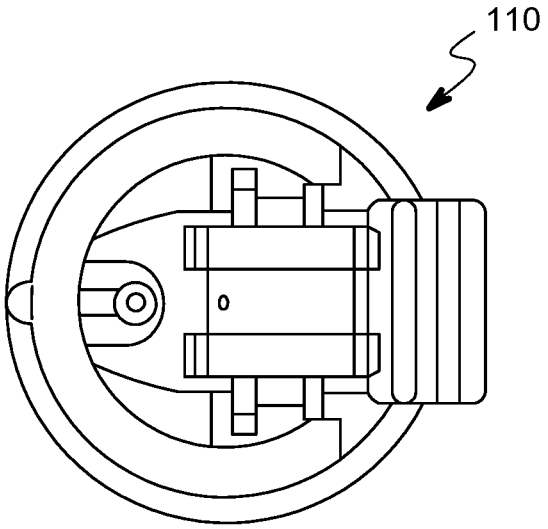
FIG. 3 is a diagram of a top view of an example lighter as described herein.

FIG. 3 is a diagram of a top view of the lighter 100. As shown in FIG. 3, the lighter 100 may include a substantially cylindrical shape. As a particular, and non-limiting, example, the lighter 100 may include an outer diameter of twenty (20) millimeters (mm), a guard of lighter component 110 may include a diameter of sixteen and nine tenths (16.9) mm, and/or a fork of lighter component 110 may include a width of nine (9) mm. Additionally, as shown, the lighter 100 may include a width of twenty-one and seven tenths (21.7) mm.

Figure 4:
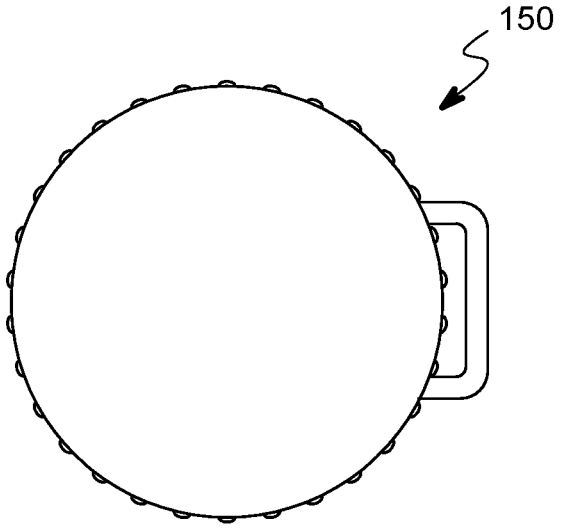
FIG. 4 is a diagram of a bottom view of an example lighter as described herein.

FIG. 4 is a diagram of a bottom view of lighter 100. As shown in FIG. 4, the accessibility component 150 of lighter 100 may include a substantially circular shape. In this way, the accessibility component 150 includes a shape that corresponds to the housing component 130 of the lighter 100.

Figure 5:
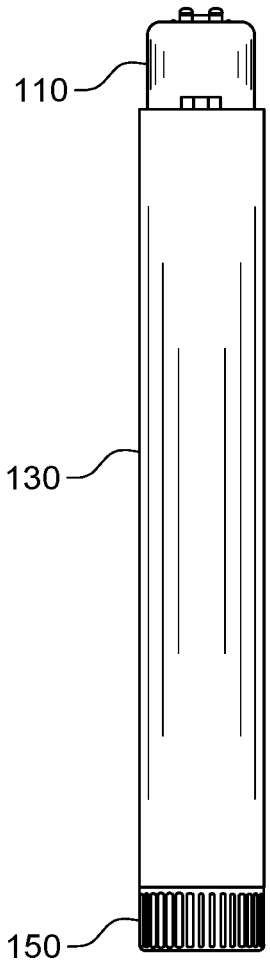
FIG. 5 is a diagram of a rear view of an example lighter as described herein.

FIG. 5 is a diagram of a rear view of the lighter 100. As compared to FIG. 1, FIG. 5 does not include a partial cross section view. In other words, FIG. 5 does not include a cross section view of the reservoir component 120 and/or the cavity component 140.

Figure 6:
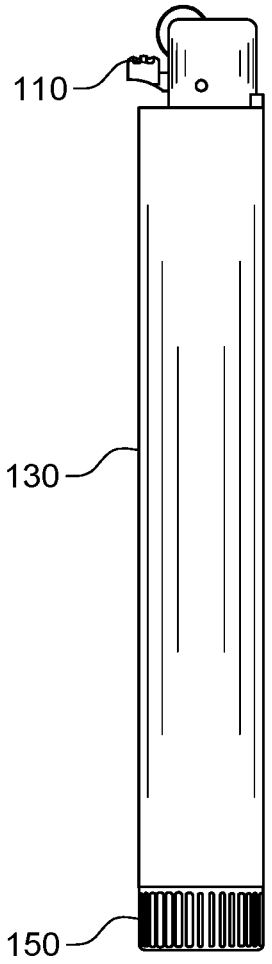
FIG. 6 is a diagram of a side view of an example lighter as described herein.

FIG. 6 is a side view of lighter 100. Referring to FIG. 6, and as a particular example, the lighter 100 may include a total length, in a vertical direction, of one hundred and fifty (150) mm. Additionally, or alternatively, a combined length of the housing component 130 and the accessibility component 150 may be one hundred and thirty four and two tenths (134.2) mm. Additionally, the accessibility component 150 may include a length of ten (10) mm. The dimensions described in connection with FIG. 6 are illustrative and non-limiting. It should be understood that other implementations include other dimensions.

Figure 7:
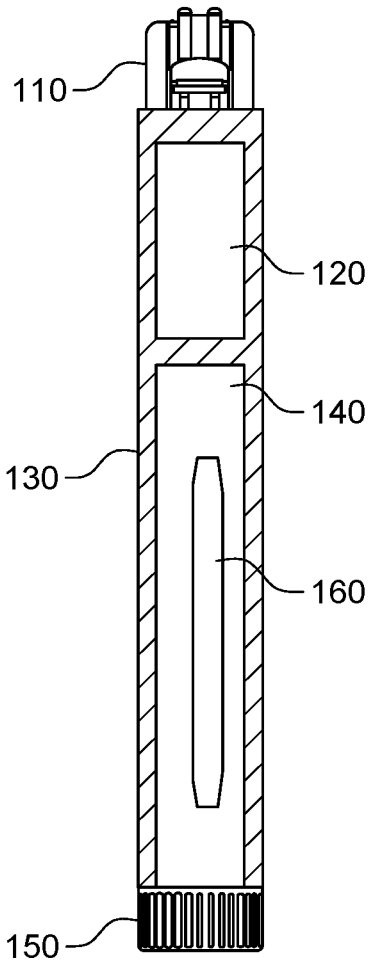
FIG. 7 is a diagram of a cross-section of a front view of an example lighter that includes a stored item as described herein.

FIG. 7 is a diagram of a cross-section of a front view of the lighter 100 that includes a stored item. As shown in FIG. 7, a smokeable item (e.g., a cigarette) may be stored within the cavity component 140 of lighter 100. In this way, the smokeable item may remain disposed within the cavity component 140 of the lighter 100 while the user carries the lighter 100 during transit.

The number and arrangement of components shown in FIGS. 1-7 are provided as an example. In practice, the lighter 100 may include additional components, fewer components, different components, or differently arranged components than those shown in FIGS. 1-7. Additionally, or alternatively, a set of components (e.g., one or more components) of the lighter 100 may perform one or more functions described as being performed by another set of components of the lighter 100.

The foregoing disclosure provides illustration and description, but is not intended to be exhaustive or to limit the implementations to the precise form disclosed. Modifications and variations are possible in light of the above disclosure or may be acquired from practice of the implementations.

Even though particular combinations of features are disclosed in the specification, these combinations are not intended to limit the disclosure of possible implementations. In fact, many of these features may be combined in ways not specifically disclosed in the specification.

No element or feature used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A lighter, comprising:

a lighter component that is configured to ignite a cigarette;

a single cylindrical housing that is connected to the lighter component and that includes a cavity to store the cigarette;

a removable cap that is configured to threadably engage with the single cylindrical housing to permit access to the cavity of the single cylindrical housing and to permit the cigarette to be stored within the cavity of the single cylindrical housing; and a reservoir that is configured to store fuel to be ignited by the lighter component, wherein the lighter component is disposed at a top end of the single cylindrical housing, and the removable cap is disposed at a bottom end of the single cylindrical housing that is opposite to the top end of the lighter, wherein the reservoir is disposed above the cavity within the single cylindrical housing, wherein the removable cap spans an entire width of the bottom end of the single cylindrical housing, and wherein a length of the cavity in a longitudinal direction of the lighter is greater than half of a total length of the lighter to permit the cavity to store the cigarette.

* * * * *